US005503129A

United States Patent [19]

Robichaux et al.

[11] Patent Number: 5,503,129

[45] Date of Patent: Apr. 2, 1996

[54] APPARATUS AND METHOD FOR MODE RECOMMENDATION IN A VARIABLE DISPLACEMENT ENGINE

[75] Inventors: Jerry D. Robichaux, Lincoln Park; Bradley J. Hieb, Dearborn, both of Mich.

[73] Assignee: Ford Motor Company, Dearborn, Mich.

[21] Appl. No.: 444,341

[22] Filed: May 18, 1995

[51] Int. Cl.[6] ..... F02D 17/02; F02M 25/07

[52] U.S. Cl. ..... 123/481; 123/571

[58] Field of Search ..... 123/481, 198 F, 123/568, 569, 571

[56] References Cited

U.S. PATENT DOCUMENTS

| | | | |
|---|---|---|---|
| 4,304,208 | 12/1981 | Etoh et al. | 123/568 |
| 4,345,571 | 8/1982 | Iizuka et al. | 123/571 |
| 4,466,404 | 8/1984 | Ueno et al. | 123/571 |
| 4,494,503 | 1/1985 | Danno et al. | 123/198 F |
| 4,721,089 | 1/1988 | Currie et al. | 123/571 |
| 5,205,260 | 4/1993 | Takahashi et al. | 123/571 |
| 5,226,390 | 7/1993 | Nakagawa | 123/571 |
| 5,265,575 | 11/1993 | Norota | 123/571 |
| 5,385,130 | 1/1995 | Hornewer et al. | 123/481 |
| 5,398,544 | 3/1995 | Lipinski et al. | 123/481 |
| 5,408,974 | 4/1995 | Lipinski et al. | 123/481 |
| 5,437,253 | 8/1995 | Huffmaster et al. | 123/481 |

OTHER PUBLICATIONS

"4,6,8 . . . Which Cylinder Shall We Operate?", *Motor*, Jun. 25, 1983, pp. 52–53.

D. Stojek and D. Bottomley, "The Ford 3×6 Engine", Proceedings IMech vol. 198D, No. 15, Mar. 6, 1984.

G. Berta, M. Troilo, "Cylinder Shut-off and Pressure Charging for Lower Fuel Consumption", SAE 82072 (date unknown).

K. Schellman and W. Schmid, "Possibilities by Saving Fuel by Switching Off Cylinders", Fuel Economy Research Conference, (Unknown data & location, & date).

T. Fukui, T. Nakagami, H. Endo, T. Katsumoto and Y. Danno, "Mitsubishi Orion–MD, A New Variable Displacement Engine," SAE 831007, Jun. 6–9, 1983.

B. Bates, J. Dosdall and D. Smith, "Variable Displacement by Engine Valve Control", SAE Paper 780145, Feb. 27–Mar. 3, 1978.

*Primary Examiner*—Willis R. Wolfe

*Attorney, Agent, or Firm*—Richard D. Dixon; Roger L. May

[57] ABSTRACT

An apparatus for determining a number of cylinders to operate in a variable displacement engine includes a signal representative of air charge temperature, a signal representative of barometric pressure, a desired mass air flow evaluator, a maximum mass air flow evaluator, a desired exhaust gas recirculation flow evaluator, a maximum exhaust gas recirculation flow evaluator, and a controller. The controller compares the desired mass air flow to the maximum mass air flow, generating a mass air flow error signal if desired mass air flow error exceeds maximum mass air flow error. The controller also compares the desired exhaust gas recirculation flow to the maximum exhaust gas recirculation flow, generating an exhaust gas recirculation flow error signal if desired exhaust gas recirculation flow exceeds maximum exhaust gas recirculation flow. The two flow error signals are combined and compared to an acceptable error threshold, and a number of cylinders upon which to operate the variable displacement engine is recommended responsive thereto.

19 Claims, 4 Drawing Sheets

APPARATUS AND METHOD FOR MODE RECOMMENDATION IN A VARIABLE DISPLACEMENT ENGINE

FIELD OF THE INVENTION

The present invention relates to a system for recommending when to operate less than the maximum possible number of cylinders of a multi-cylinder variable displacement engine, and, more particularly, to utilizing mass air flow and exhaust gas recirculation flow to make this recommendation.

DESCRIPTION OF THE RELATED ART

Automotive vehicle designers and manufacturers have realized for years that it is possible to obtain increased fuel efficiency by operating an engine on less than its full complement of cylinders during certain running conditions. Accordingly, at low speed, low load operation, it is possible to save fuel by operating the engine on four cylinders instead of eight cylinders, or three cylinders instead of six cylinders. In fact, one manufacturer offered a 4-6-8 variable displacement engine several years ago.

Also, Ford Motor Company designed a six cylinder engine which was capable of operating on three cylinders. While never released for production, Ford's engine was developed to a highly refined state. Unfortunately, both of the aforementioned engines suffered from deficiencies associated with their control strategies. Specifically, customer acceptance of the engine actually in production was unsatisfactory because the powertrain tended to "hunt" or shift frequently between the various cylinder operating modes. In other words, the engine would shift from four to eight cylinder operation frequently, producing noticeable torque excursions. This caused the driver to perceive excessive changes in transmission gear in the nature of downshifting or upshifting. Another drawback to prior art systems was that neither engine emissions nor mass air flow were properly accounted for in deciding whether reduced cylinder operation was desirable or feasible. Thus prior art systems did not always assure that the driver's demand for torque was met.

As detailed in U.S. patent application Ser. No. 08/172,359, now U.S. Pat. No. 5,408,974, Ford initially addressed some of the aforementioned concerns by utilizing inferred engine load based on accelerator control position as a decision criteria. Ford's U.S. patent application Ser. No. 08/400,066, filed Mar. 7, 1995, still pending reflects an improvement to this earlier invention which utilizes inferred desired manifold pressure as a decision criteria. The present invention is directed at increasing the robustness of this improved system by accounting for the mass air flow and exhaust gas recirculation flow requirements associated with a driver's demanded torque in recommending whether to operate an engine on less than its full complement of cylinders.

SUMMARY OF THE INVENTION

An apparatus for recommending a number of cylinders to operate in a variable displacement engine includes a signal representative of air charge temperature, a signal representative of barometric pressure, a desired mass air flow evaluator, a maximum mass air flow evaluator, a desired exhaust gas recirculation flow evaluator, a maximum exhaust gas recirculation flow evaluator, and a controller.

The controller compares the desired mass air flow, which is necessary to provide a desired torque for a engine operating on a fractional number of cylinders under a specific emissions calibration, with the maximum mass air flow possible under present atmospheric conditions, as determined by barometric pressure and air charge temperature, generating a mass air flow error signal if the desired mass air flow exceeds the maximum mass air flow. The controller also compares the desired exhaust gas recirculation flow, which must be accommodated to meet emissions requirements for an engine operating on a fractional number of cylinders to provide a desired torque, with the maximum exhaust gas recirculation flow that could possibly be accommodated under present atmospheric and engine conditions for a fractionally operating engine, as represented by barometric pressure and a desired manifold pressure. The controller generates an exhaust gas recirculation flow error signal if the desired exhaust gas recirculation flow exceeds the maximum exhaust gas recirculation flow. The mass air flow error signal and exhaust gas recirculation flow error signal are combined and compared to an acceptable error threshold, and the controller recommends a number of cylinders upon which to operate the variable displacement engine responsive thereto.

A primary object of the present invention is to provide a new and improved system for recommending when to operate less than the maximum possible number of cylinders of a multi-cylinder variable displacement engine. More specifically, it is an object of the present invention to utilize exhaust gas recirculation flow and mass air flow to make this recommendation.

A primary advantage of this invention is that it more directly addresses the engine's ability to meet a driver's demand for torque in determining whether to recommend operating in fractional mode. An additional advantage is that the invention accounts for emissions requirements in making its recommendation.

Other objects, features, and advantages will be apparent from a study of the following written description and drawings.

DETAILED DESCRIPTION OF THE PREFERRED EMBODIMENTS

Figure 1:
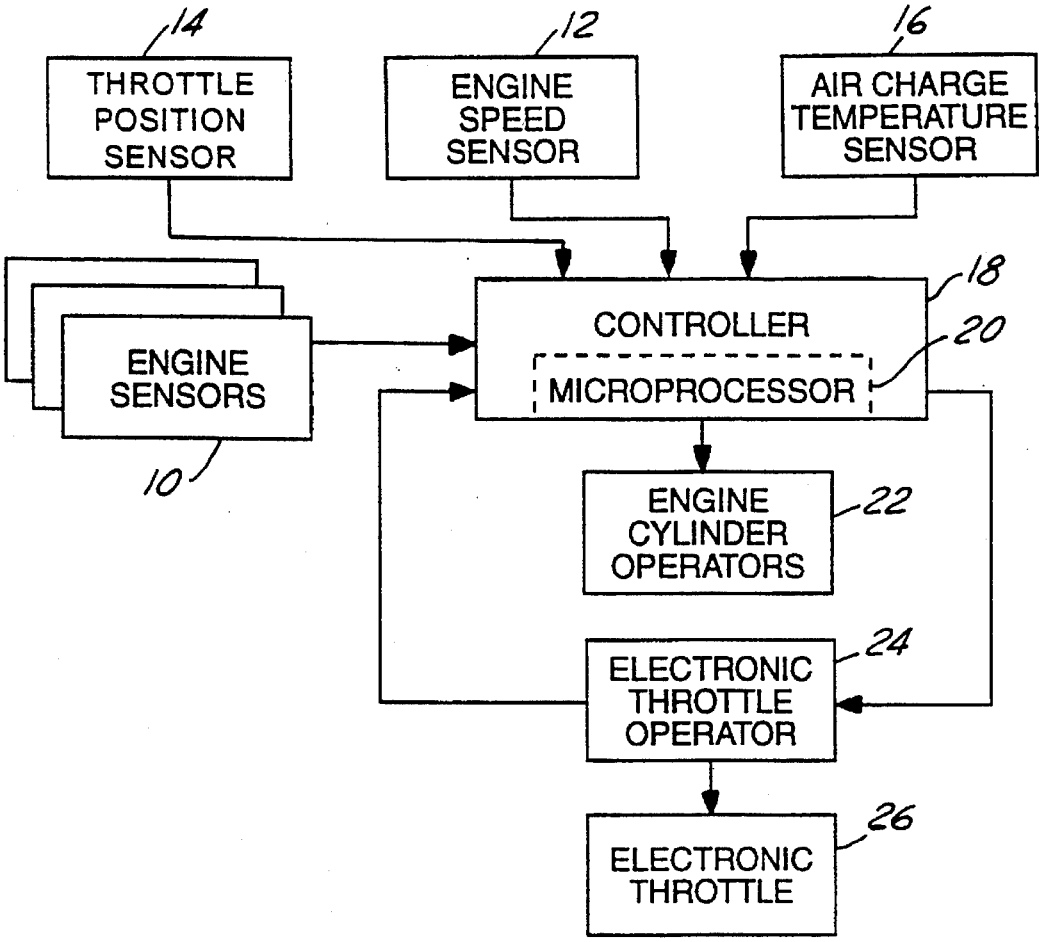
FIG. 1 is a block diagram of a variable displacement engine mode selection system according to the present invention.

Referring now to FIG. 1, a mode selection system for a variable displacement engine has an engine speed sensor 12 for sensing engine speed, a throttle position sensor 14 for sensing the position of one or more intake air throttles, an air charge temperature sensor 16 for measuring the temperature of air flowing into the engine, and additional assorted engine sensors 10 for measuring other engine characteristics. Sensors 10, 12, 14, 16 provide signals to a controller 18 of the type commonly used for providing engine control.

Controller 18 includes a microprocessor 20 that utilizes input from various sensors such as sensors 10, 12, 14, and 16, which may include air charge temperature, engine speed, engine coolant temperature, and other sensors known to those skilled in the art and suggested by this disclosure. In addition to sensor input, microprocessor 20 also utilizes its own stored information (not shown), which may include limit values for various engine parameters or time-oriented data. Controller 18 may operate spark timing/control, air/fuel ratio control, exhaust gas recirculation (EGR), intake airflow, and other engine and power transmission functions. In addition, through a plurality of engine cylinder operators 22, controller 18 has the capability of disabling selected cylinders in the engine, causing the engine to have a decreased effective displacement. An engine operating with less than its full complement of cylinders is said to be in fractional mode, as opposed to maximum mode which utilizes all engine cylinders to provide maximum effective displacement. For example, with an eight-cylinder engine, controller 18 may operate the engine on three, four, five, six, seven, or eight cylinders, as warranted by the driver's demanded torque, a specific emissions calibration, and environmental conditions.

Those skilled in the art will appreciate in view of this disclosure that a number of different disabling devices are available for selectively rendering inoperative one or more engine cylinders. Such devices include mechanisms for preventing any of the cylinder valves in a disabled cylinder from opening, such that gas remains trapped within the cylinder.

Controller 18 operates electronic throttle operator 24, which may comprise a torque motor, stepper motor, or other type of device which positions an electronic throttle 26. Electronic throttle 26 is different from a mechanical throttle, which may be employed in connection with a manually operable accelerator control. The term maximum relative throttle position is used to refer to the cumulative restriction of the intake caused by whatever limits the control system has placed on the ability of the mechanical throttle and/or the electronic throttle to go wide-open. Electronic throttle operator 24 provides feedback to controller 18 regarding the position of the electronic throttle 26.

Figure 2A:
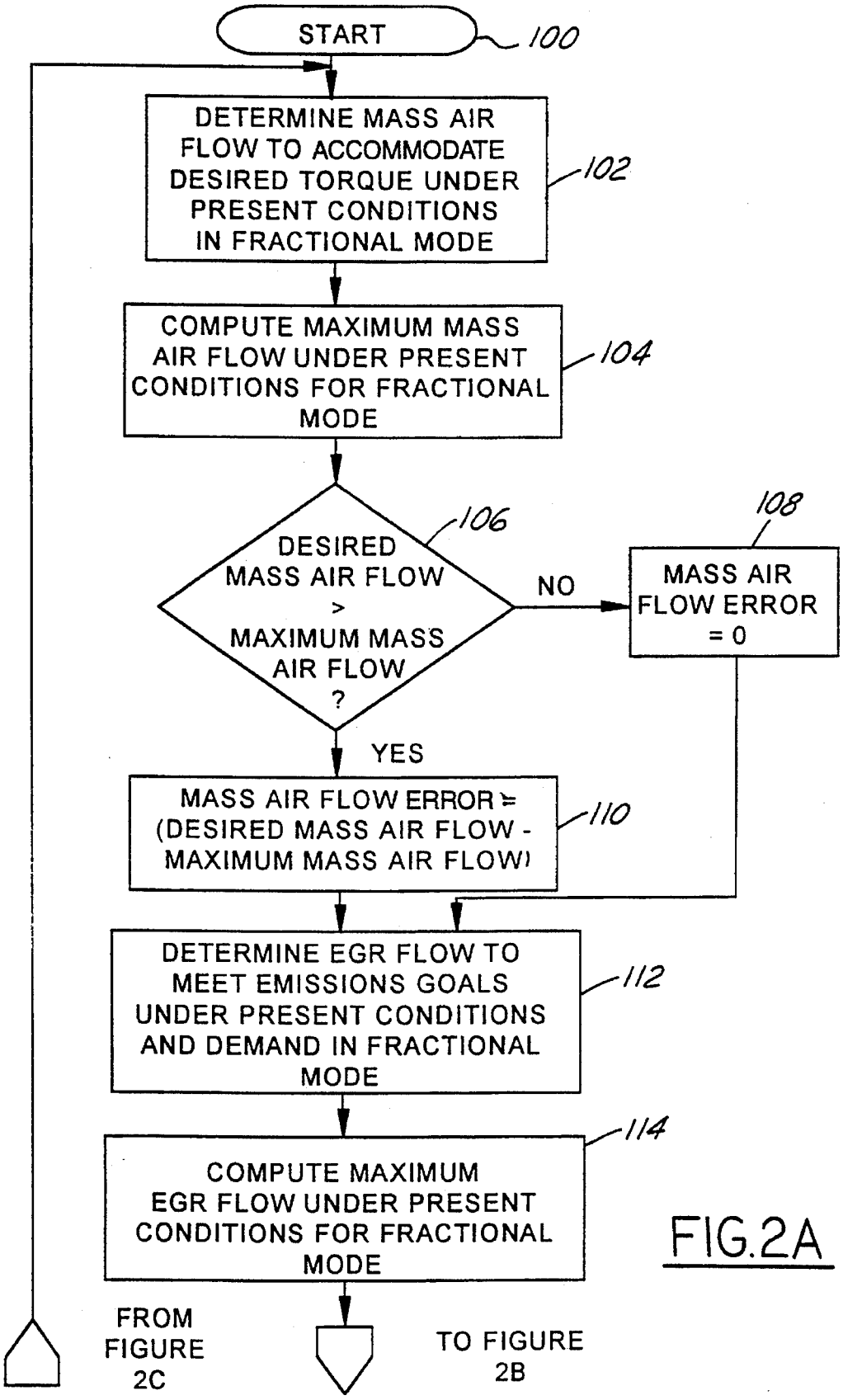
FIGS. 2*a*, 2*b*, and 2*c* are a flow chart of a preferred embodiment showing a mode selection process for a variable displacement engine according to the present invention.

Turning now to FIG. 2*a*, a preferred embodiment of a method for selecting the operating mode of a variable displacement engine begins at block 100 with the start of the cycle. At block 102 the system evaluates the mass air flow which would be necessary to operate the engine on a fractional number of cylinders (a "fractionally operating engine"), considering the driver's current torque demand. This quantity is known as the desired mass air flow. More specifically, it is the quantity of air per unit time that must flow into the operating cylinders to meet the demanded torque. Desired mass air flow is chiefly a function of the air charge per cylinder, the number of operating cylinders, and the number of engine rotations per minute. It can be computed by either inferring or measuring the aforementioned parameters, depending on the degree of precision desired, and then multiplying them together. In a preferred embodiment, the system also takes into account the specific emissions calibration of the engine.

At block 104 the system determines the maximum mass of air that can flow through a fractionally operating engine under present cylinder charging conditions. In a preferred embodiment, these conditions include barometric pressure and air charge temperature. They may also include maximum relative throttle position, depending on what throttle control hardware and/or strategy is being used. Barometric pressure is considered because as it decreases, the density of air decreases, resulting in less air mass for a fixed volume. This in turn reduces the mass air flow. For example, a vehicle operating at a high altitude, where barometric pressure is reduced, will have less maximum mass air flow than a vehicle operating under identical conditions but at a lower altitude. Note that barometric pressure can be measured directly or inferred from other data.

Similarly, the temperature of the air charge is considered in a preferred embodiment because it also affects the density of the air, which in turn impacts the maximum mass air flow. For example, warm air is less dense than cold air, so maximum mass air flow is greater at cooler temperatures. Note that air charge temperature can be measured directly or inferred from other data.

Relative throttle position may be considered in a preferred embodiment if the mechanical throttle and/or the electronic throttle are restricted from going wide-open for control purposes. Such a restriction within the passage through which the air reaches the engine can limit the maximum mass air flow, depending on what throttle control strategy is used. Note that a preferred embodiment represents this as a constant in the system strategy for simplification, but a variable signal could be utilized if desired.

While a preferred embodiment utilizes barometric pressure and air charge temperature to determine the maximum mass air flow for a fractionally operating engine, other signals could be used in addition to or in place of these, depending on the nature of the engine and the degree of precision desired.

Continuing with FIG. 2*a*, at block 106 the system compares the desired mass air flow to the maximum mass air flow. If the desired mass air flow is smaller, then the system can accommodate the mass air flow requirement associated with operating in fractional mode, so the mass air flow error is set to zero at block 108. If the desired mass air flow exceeds the maximum mass air flow, then system cannot meet the mass air flow requirement associated with fractional operation. The mass air flow error is set to the amount by which the desired mass air flow exceeds the maximum mass air flow at block 110, and the system proceeds to investigate EGR flows.

Continuing with FIG. 2*a*, the system now determines at block 112 the flow of exhaust gas which must be recirculated to meet the predetermined emissions goals for a fractionally operating engine. For simplicity, a preferred embodiment uses some percentage of the desired mass air flow established earlier, but more complex methods are also acceptable.

The system then determines the maximum mass of exhaust gas that can be recirculated through a fractionally operating engine under present atmospheric conditions at block 114. In a preferred embodiment, the system uses barometric pressure, a desired manifold pressure associated with fractional operation, and the corresponding desired mass air flow required for fractional operation, but other means of calculating the maximum EGR flow could be used if desired. Barometric pressure is useful because as atmospheric pressure decreases, such as at high altitudes, less EGR can be accommodated without degrading engine performance. The thinner air at high altitude dictates that a greater percentage of fresh air, as determined by the desired mass air flow, is needed to maintain the proper air/fuel ratio.

Figure 2B:
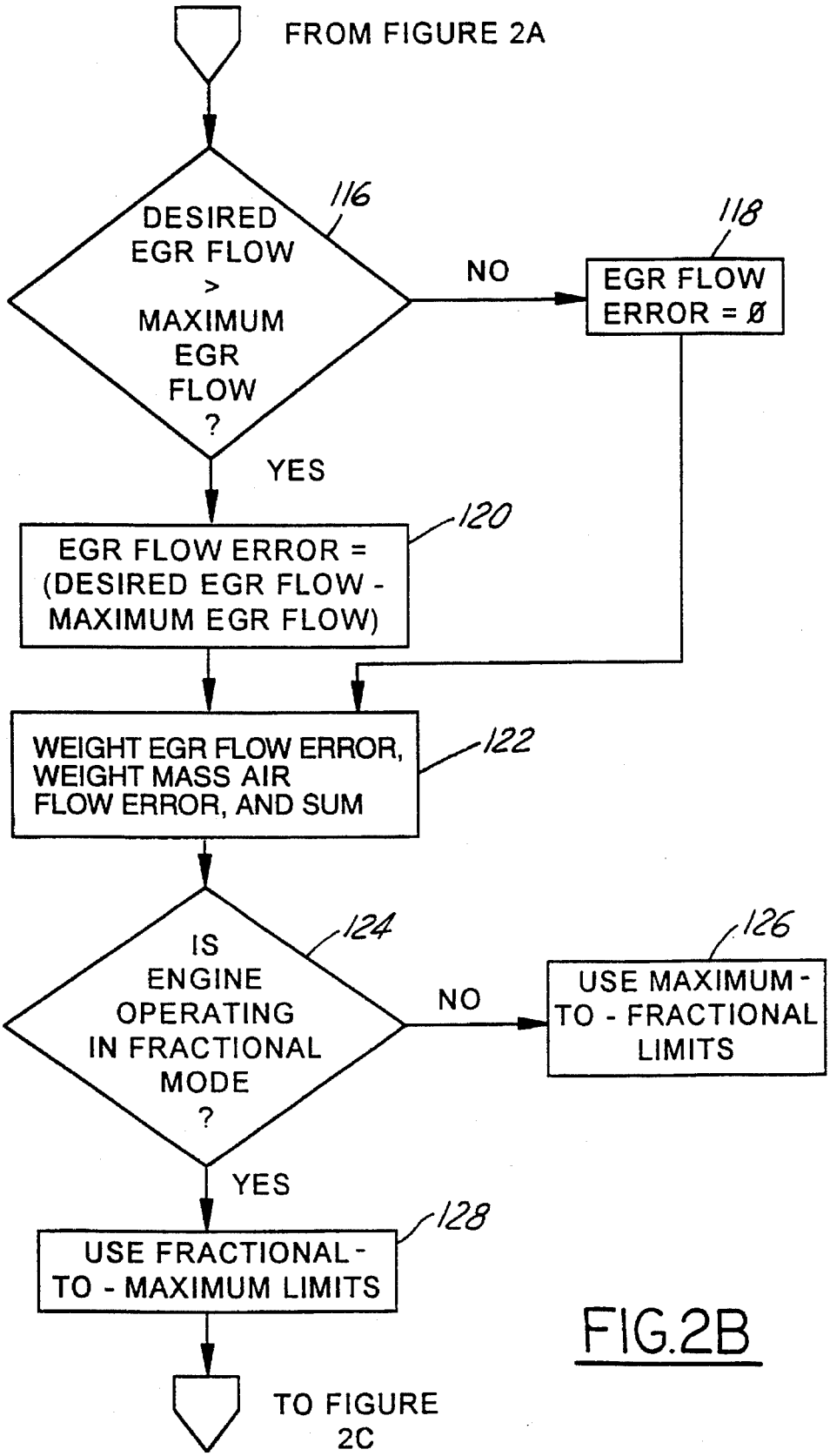

Turning now to FIG. 2*b*, the system continues by comparing the desired EGR flow to the maximum EGR flow at block 116. If the desired EGR flow does not exceed the maximum EGR flow at block 118, then the EGR flow error is zero. Otherwise, the EGR flow error equals that amount by which desired EGR flow exceeds maximum EGR flow at block 120.

The system next sums the mass air flow error with the EGR flow error at block 122. In a preferred embodiment, the system weights each flow error, multiplying it by a predetermined amount before summing. While this weighing is not essential, it does permit one flow error to count more significantly than the other, which may be desirable under some control strategies. Note also that the mass air flow error could be weighted earlier, such as immediately after it was computed, instead of at this point. It is shown here for simplicity's sake.

Continuing with FIG. 2*b*, a preferred embodiment next looks at whether the engine is presently operating on a fractional number of cylinders at block 124, so it may choose an error threshold. For an engine operating on the maximum number of cylinders, a maximum-to-fractional threshold is chosen at block 126, which indicates the maximum amount of acceptable flow error for which the system will recommend switching to fractional operation. For a fractionally operating engine, a fractional-to-maximum threshold is selected at block 128, which indicates the minimum amount of flow error for which the system will recommend a return to maximum operation. While a preferred embodiment utilizes a pair of error thresholds, greater or fewer thresholds could be used if desired. The dual error threshold arrangement of the present invention provides hysteresis by setting the fractional-to-maximum threshold higher than the maximum-to-fractional threshold, which reduces excessive mode switching that can arise with single threshold systems.

Figure 2C:
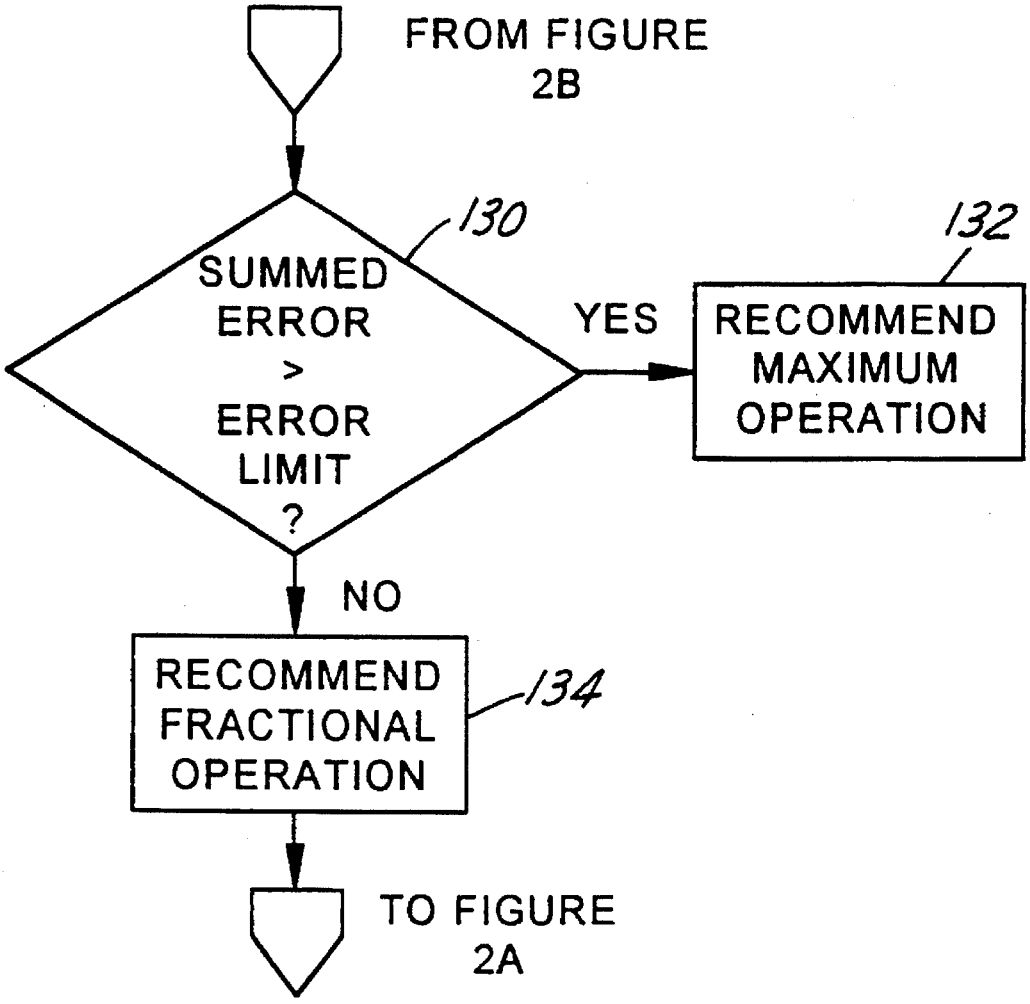

Turning now to FIG. 2*c*, the system compares the sum of the flow errors with the selected error threshold at block 130. If the error exceeds the threshold at block 132, then the system recommends that the engine operate on its maximum number of cylinders, because the flow necessary to accommodate the desired torque cannot be met under present conditions and given the specific emissions calibration. If the error does not exceed the threshold at block 134, then the system recommends that the engine operate on a fractional number of cylinders.

Note that while either mass air flow or exhaust gas recirculation flow could be used by itself as a decision criteria, a preferred embodiment utilizes both flows in making its recommendation of an operating mode to the engine. Utilizing both mass air flow and exhaust gas recirculation flow provides greater robustness in recommending an operating mode, especially since small errors in both flows may combine to alter the recommendation which might be made if each flow was analyzed by itself.

From the foregoing description, one ordinarily skilled in the art can easily ascertain the essential characteristics of this invention and, without departing from the spirit and scope of the claims, can make various changes and modifications to the invention to adapt it to various usages and conditions.

We claim:

1. An apparatus for determining a number of cylinders to operate in a variable displacement engine, comprising:

pressure means for inferring a present barometric pressure;

temperature means for inferring a present air charge temperature;

desired mass air flow means for evaluating a desired mass air flow required to accommodate a desired torque and a specific emissions calibration for the variable displacement engine operating on a fractional number of cylinders;

maximum mass air flow means for evaluating a maximum mass air flow, representative of the largest quantity of mass air flow which the variable displacement engine operating on a fractional number of cylinders can provide, under said present barometric pressure and said present air charge temperature;

desired exhaust gas recirculation flow means for evaluating a desired exhaust gas recirculation flow that must be accommodated by the variable displacement engine operating on a fractional number of cylinders under said desired torque and said specific emissions calibration;

maximum exhaust gas recirculation flow means for evaluating a maximum exhaust gas recirculation flow, representative of the largest quantity of exhaust gas recirculation which the variable displacement engine operating on a fractional number of cylinders can accommodate responsive to said present barometric pressure; and a controller for recommending whether the variable displacement engine should be operated on a fractional number of cylinders, said controller being responsive to said desired mass air flow, said maximum mass air flow, said desired exhaust gas recirculation flow, and said maximum exhaust gas recirculation flow, and said controller further comprising mass air flow comparing means for comparing said desired mass air flow to said maximum mass air flow and generating a mass air flow error signal, representative of an air flow amount by which said desired mass air flow exceeds said maximum mass air flow, exhaust gas recirculation flow comparing means for comparing said desired exhaust gas recirculation flow to said maximum exhaust gas recirculation flow and generating an exhaust gas recirculation flow error signal, representative of an exhaust gas amount by which said desired exhaust gas recirculation flow exceeds said maximum exhaust gas recirculation flow, and recommending means for recommending a number of cylinders upon which to operate the variable displacement engine, said recommending means being responsive to said exhaust gas recirculation flow error and said mass air flow error.

2. An apparatus according to claim 1, further comprising throttle position means for sensing a maximum relative throttle position, and wherein said maximum mass air flow means is limited by said maximum relative throttle position.

3. An apparatus according to claim 1, wherein said mass air flow comparing means utilizes a first weighted step function for generating said mass air flow error signal.

4. An apparatus according to claim 3, wherein said exhaust gas recirculation comparing means utilizes a second weighted step function for generating said exhaust gas recirculation flow error signal.

5. An apparatus according to claim 1, wherein said recommending means combines said mass air flow error signal with said exhaust gas recirculation flow error signal to create a combined flow error signal and recommends a number of cylinders upon which to operate the variable displacement engine responsive to said combined flow error signal.

6. An apparatus according to claim 1, said recommending means further comprising a first threshold and a summer for adding said mass air flow error signal and said exhaust gas recirculation flow error signal into a sum, and wherein said recommending means recommends that the variable displacement engine operate on a fractional number of cylinders if said sum is less than said first threshold.

7. An apparatus according to claim 6, said recommending means further comprising a second threshold, and wherein said recommending means utilizes said first threshold when the variable displacement engine is presently operating on a fractional number of cylinders, and utilizes said second threshold when the variable displacement engine is presently operating on a maximum number of cylinders.

8. An apparatus for determining a number of cylinders to operate in a variable displacement engine, comprising:

pressure means for inferring a present barometric pressure;

temperature means for inferring a present air charge temperature;

desired mass air flow means for evaluating a desired mass air flow required to accommodate a desired torque and a specific emissions calibration for the variable displacement engine operating on a fractional number of cylinders;

maximum mass air flow means for evaluating a maximum mass air flow, representative of the largest quantity of mass air flow which the variable displacement engine operating on a fractional number of cylinders can provide responsive to said present barometric pressure and said present air charge temperature; and a controller for recommending whether the variable displacement engine should be operated on a fractional number of cylinders responsive to said desired mass air flow and said maximum mass air flow, said controller further comprising mass air flow comparing means for comparing said desired mass air flow to said maximum mass air flow and generating a mass air flow error signal, representative of an air flow amount by which said desired mass air flow exceeds said maximum mass air flow, and recommending means for recommending a number of cylinders upon which to operate the variable displacement engine responsive to said mass air flow error signal.

9. An apparatus according to claim 8, further comprising throttle position means for sensing a maximum relative throttle position, and wherein said maximum mass air flow means is limited by said maximum relative throttle position.

10. An apparatus according to claim 8, wherein said mass air flow comparing means utilizes a weighted step function for generating said mass air flow error.

11. An apparatus according to claim 8, said recommending means further comprising a first threshold, and wherein said recommending means recommends that the variable displacement engine operate on a fractional number of cylinders if said mass air flow error is less than said first threshold.

12. An apparatus according to claim 11, said recommending means further comprising a second threshold, and wherein said recommending means utilizes said first threshold when the variable displacement engine is presently operating on a fractional number of cylinders, and utilizes said second threshold when the variable displacement engine is presently operating on a maximum number of cylinders.

13. An apparatus for determining a number of cylinders to operate in a variable displacement engine, comprising:

pressure means for inferring a present barometric pressure;

desired exhaust gas recirculation flow means for evaluating a desired exhaust gas recirculation flow that must be accommodated by the variable displacement engine operating on a fractional number of cylinders responsive to said desired torque and said specific emissions calibration;

maximum exhaust gas recirculation flow means for evaluating a maximum exhaust gas recirculation flow, representative of the largest quantity of exhaust gas recirculation which the variable displacement engine operating on a fractional number of cylinders can accommodate responsive to said present barometric pressure; and a controller for recommending whether the variable displacement engine should be operated on a fractional number of cylinders responsive to said desired exhaust gas recirculation flow and said maximum exhaust gas recirculation flow, said controller further comprising exhaust gas recirculation flow comparing means for comparing said desired exhaust gas recirculation flow to said maximum exhaust gas recirculation flow and generating an exhaust gas recirculation flow error signal, representative of an exhaust gas amount by which said desired exhaust gas recirculation flow exceeds said maximum exhaust gas recirculation flow, and recommending means for recommending a number of cylinders upon which to operate the variable displacement engine responsive to said exhaust gas recirculation flow error.

14. An apparatus according to claim 13, wherein said exhaust gas recirculation flow comparing means utilizes a weighted step function for generating said exhaust gas recirculation flow error.

15. An apparatus according to claim 13, said recommending means further comprising a first threshold, and wherein said recommending means recommends that the variable displacement engine operate on a fractional number of cylinders if said exhaust gas recirculation flow error signal is less than said first threshold.

16. An apparatus according to claim 15, said recommending means further comprising a second threshold, and wherein said recommending means utilizes said first threshold when the variable displacement engine is presently operating on a fractional number of cylinders, and utilizes said second threshold when the variable displacement engine is presently operating on a maximum number of cylinders.

17. A method of determining a number of cylinders to operate in a variable displacement engine, comprising the steps of:

evaluating a desired mass air flow necessary to accommodate a desired torque and a specific emissions calibration for the variable displacement engine operating on a fractional number of cylinders;

evaluating a maximum mass air flow which the variable displacement engine operating on a fractional number of cylinders can provide responsive to a present barometric pressure and a present air charge temperature;

subtracting said maximum mass air flow from said desired mass air flow to generate a mass air flow error signal;

setting said mass air flow error signal to zero if said maximum mass air flow exceeds said desired mass air flow;

evaluating a desired exhaust gas recirculation flow that must be accommodated by the variable displacement engine operating on a fractional number of cylinders responsive to said desired torque and said specific emissions calibration;

evaluating a maximum exhaust gas recirculation flow that the variable displacement engine operating on a fractional number of cylinders can accommodate under said present barometric pressure;

subtracting said maximum exhaust gas recirculation flow from said desired exhaust gas recirculation flow to generate an exhaust gas recirculation flow error signal;

setting said exhaust gas recirculation flow error signal to zero if said maximum exhaust gas recirculation flow exceeds said desired exhaust gas recirculation flow;

adding said mass air flow error signal to said exhaust gas recirculation error signal to generate a total flow error signal;

comparing said total flow error signal to an error threshold; and recommending that the variable displacement engine operate on a fractional number of cylinders if said total flow error signal does not exceed said threshold.

18. A method according to claim 17, further comprising the step of selecting one of a plurality of error thresholds responsive to whether the variable displacement engine is operating on a fractional number of cylinders before said comparing step.

19. A method according to claim 17, further comprising the steps of multiplying said mass air flow error signal by a predetermined mass air flow error weight before said adding step, and multiplying said exhaust gas recirculation flow error signal by a predetermined exhaust gas recirculation flow error weight before said adding step.

* * * * *